US010421106B2

(12) United States Patent
Norikura

(10) Patent No.: US 10,421,106 B2
(45) Date of Patent: Sep. 24, 2019

(54) ROLLING MILL AND ROLLING METHOD

(71) Applicant: PRIMETALS TECHNOLOGIES JAPAN, LTD., Tokyo (JP)

(72) Inventor: Takashi Norikura, Tokyo (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 598 days.

(21) Appl. No.: 15/203,923

(22) Filed: Jul. 7, 2016

(65) Prior Publication Data

US 2017/0008055 A1 Jan. 12, 2017

(30) Foreign Application Priority Data

Jul. 8, 2015 (JP) ..... 2015-136696

(51) Int. Cl.

| | |
|---|---|
| ***B21B 37/58*** | (2006.01) |
| ***B21B 13/14*** | (2006.01) |
| ***B21B 31/20*** | (2006.01) |
| ***B21B 27/02*** | (2006.01) |
| ***B21B 31/32*** | (2006.01) |

(Continued)

(52) U.S. Cl.

CPC ..... *B21B 37/58* (2013.01); *B21B 13/14* (2013.01); *B21B 31/20* (2013.01); *B21B 13/142* (2013.01); *B21B 27/021* (2013.01); *B21B 31/32* (2013.01); *B21B 38/08* (2013.01); *B21B 2013/028* (2013.01)

(58) Field of Classification Search

CPC ..... B21B 13/14; B21B 13/142; B21B 27/021; B21B 31/20; B21B 31/32; B21B 37/58; B21B 38/08; B21B 2013/028

See application file for complete search history.

(56) References Cited

U.S. PATENT DOCUMENTS 5,622,073 A * 4/1997 Hiruta ..... B21B 13/142 72/247
6,250,126 B1 6/2001 Yasuda et al.

FOREIGN PATENT DOCUMENTS

| | | |
|---|---|---|
| EP | 2241382 A1 | 10/2010 |
| EP | 2277637 A1 | 1/2011 |
| EP | 2 572 808 A1 | 3/2013 |

(Continued)

OTHER PUBLICATIONS

Office Action dated Oct. 19, 2018 issued in corresponding JP Application No. 2015-136696 with an English Translation.

*Primary Examiner* — Teresa M Ekiert

(74) *Attorney, Agent, or Firm* — Birch, Stewart, Kolasch & Birch, LLP

(57) ABSTRACT

A rolling mill includes: work rolls configured to roll a rolling material; intermediate rolls supporting the work rolls from above and below, respectively; back-up rolls supporting the intermediate rolls from above and below, respectively; position adjusting means for adjusting the positions of the intermediate rolls relative to the work rolls and the back-up rolls in the direction of conveyance of the rolling material; detecting means for detecting horizontal forces on the work rolls; offset-amount calculating means for calculating the offset amounts of the intermediate rolls based on the horizontal forces on the work rolls detected by the detecting means; and controlling means for controlling the position adjusting means such that the positions of the intermediate rolls are offset by the offset amounts calculated by the offset-amount calculating means.

5 Claims, 18 Drawing Sheets

(51) Int. Cl.

| | |
|---|---|
| *B21B 38/08* | (2006.01) |
| *B21B 13/02* | (2006.01) |

(56) References Cited

FOREIGN PATENT DOCUMENTS

| | | | |
|---|---|---|---|
| EP | 2777834 | A1 | 9/2014 |
| JP | 60-186901 | U | 12/1985 |
| JP | 3-207506 | A | 9/1991 |
| JP | 10-58011 | A | 3/1998 |
| JP | 11-347607 | A | 12/1999 |
| WO | WO 2013/042204 | A1 | 3/2013 |

* cited by examiner

ROLLING MILL AND ROLLING METHOD

TECHNICAL FIELD

The present invention relates to a rolling mill and a rolling method for rolling a rolling material such as a metal strip.

BACKGROUND ART

In recent years, in the rolling of hard materials such as electrical steel strips, high tensile strength steel, and stainless steel, the diameters of work rolls have been reduced for the purpose of reducing rolling load. However, the reduction in diameter of work rolls causes insufficient spindle strength and thus requires switching from work-roll drive to intermediate-roll drive. Here, drive tangential forces from those intermediate rolls deflect the work rolls. This has led to a problem in that the deflection distorts the strip shape and makes it impossible to achieve stable rolling. Also even with the work-roll drive, the work rolls will be deflected if the difference in tension is large between the inlet side and the outlet side of the work rolls. This has led to a similar problem in that stable rolling cannot be achieved. For these reasons, there has been a strong demand for a technique of minimizing the deflection of the work rolls.

Patent Literature 1 listed below, for example, discloses a technique addressing the case where intermediate-roll drive is used due to reduction in diameter of work rolls. Specifically, in the technique, each intermediate roll is variably offset so that a tangential force applied to the corresponding work roll by a drive torque of the intermediate roll and a component of a load can be balanced with each other. Also, Patent Literature 1 discloses a method of controlling the amount of offset of the intermediate roll by detecting horizontal deflection of the work roll with a gap sensor.

CITATION LIST

Patent Literature

{Patent Literature}Japanese Patent Application Publication No. Hei 10-58011

SUMMARY OF INVENTION

Technical Problems

Meanwhile, in rolling methods as described above, it has been a common, conventional practice to distribute drive force from a single drive motor to an upper intermediate roll and a lower intermediate roll via pinions. For this reason, calculation is made on the assumption that the drive torque on the upper side and the drive torque on the lower side are the same. However, the torque circulation occurs on the upper side and the lower side and thereby causes up to a 30% difference in drive torque depending on the rolling condition in some cases. In these cases, the drive torque difference cannot be balanced, so that a force acting in a horizontal direction (horizontal force) remains in the work roll and accordingly deflects the work roll in the horizontal direction. This leads to a problem of deterioration in the strip shape of the rolling material.

Note that, in order to accurately detect the horizontal deflection of each work roll in Patent Literature 1 above, it is necessary to place the above-mentioned gap sensor on the horizontal side surface of the work roll at the center in the roll length direction. However, if the gap sensor is placed at such a position, the gap sensor may possibly break due to strip breaking in the rolling material. Also, since the gap sensor is in a poor environment where roll coolant is sprayed, erroneous detection of the gap sensor may possibly occur. Even with work-roll drive, erroneous detection may possibly occur as well if the difference in tension is large between the inlet side and the outlet side in the conveyance direction of the rolling material relative to the work roll.

In view of the above, the present invention has been made to solve the problems mentioned above, and an object thereof is to provide a rolling mill and a rolling method capable of obtaining a rolling material with a good strip shape even when the diameters of work rolls are reduced for the purpose of reducing rolling load.

Solution to Problem

A rolling mill according to the present invention for solving the problems mentioned above is a rolling mill including:

- upper and lower work rolls as a pair configured to roll a rolling material;
- upper and lower intermediate rolls as a pair supporting the paired upper and lower work rolls from above and below, respectively, and being supported movably in a roll axial direction, the paired upper and lower intermediate rolls including tapering sections at end portions of the paired upper and lower intermediate rolls that are point-symmetric about a center of the rolling material in a strip width direction thereof;
- upper and lower back-up rolls as a pair supporting the paired upper and lower intermediate rolls from above and below, respectively;
- position adjusting means for adjusting positions of the paired upper and lower intermediate rolls relative to the paired upper and lower work rolls and the paired upper and lower back-up rolls in a direction of conveyance of the rolling material;
- detecting means for detecting horizontal forces on the work rolls;
- offset-amount calculating means for calculating offset amounts of the intermediate rolls based on the horizontal forces on the work rolls detected by the detecting means; and
- controlling means for controlling the position adjusting means such that the positions of the intermediate rolls are offset by the offset amounts calculated by the offset-amount calculating means.

Also, a rolling method according to the present invention for solving the problems mentioned above is a rolling method using a rolling mill including

- upper and lower work rolls as a pair configured to roll a rolling material,
- upper and lower intermediate rolls as a pair supporting the paired upper and lower work rolls from above and below, respectively, and being supported movably in a roll axial direction, the paired upper and lower intermediate rolls including tapering sections at end portions of the paired upper and lower intermediate rolls that are point-symmetric about a center of the rolling material in a strip width direction thereof,
- upper and lower back-up rolls as a pair supporting the paired upper and lower intermediate rolls from above and below, respectively, and
- position adjusting means for adjusting positions of the paired upper and lower intermediate rolls relative to the paired upper and lower work rolls and the paired upper and lower back-up rolls in a direction of conveyance of the rolling material, the rolling method including:

detecting horizontal forces on the paired upper and lower work rolls;

calculating offset amounts of the intermediate rolls based on the detected horizontal forces on the work rolls; and controlling the position adjusting means such that the positions of the intermediate rolls are offset by the calculated offset amounts.

Advantageous Effect of Invention

With the present invention, a rolling material with a good strip shape can be obtained even when the diameters of work rolls are reduced for the purpose of reducing rolling load.

DESCRIPTION OF EMBODIMENTS

Embodiments of a rolling mill, a tandem rolling line including the same, and a rolling method according to the present invention will be described below. Note that the present invention is not limited only to the following embodiments to be described based on the drawings.

{Embodiment 1}

Figure 1:
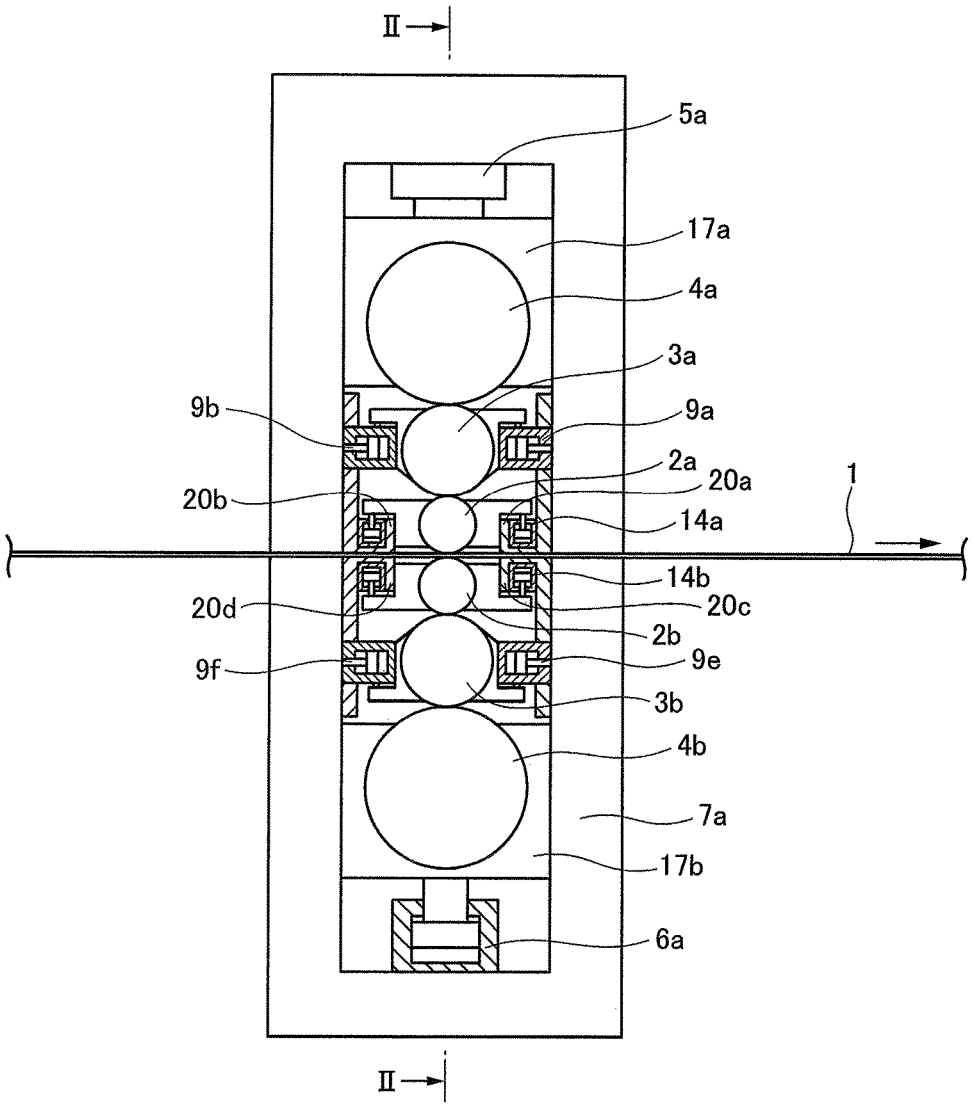
FIG. 1 is an elevational view of a six-high rolling mill according to a first embodiment of the present invention.
Figure 2:
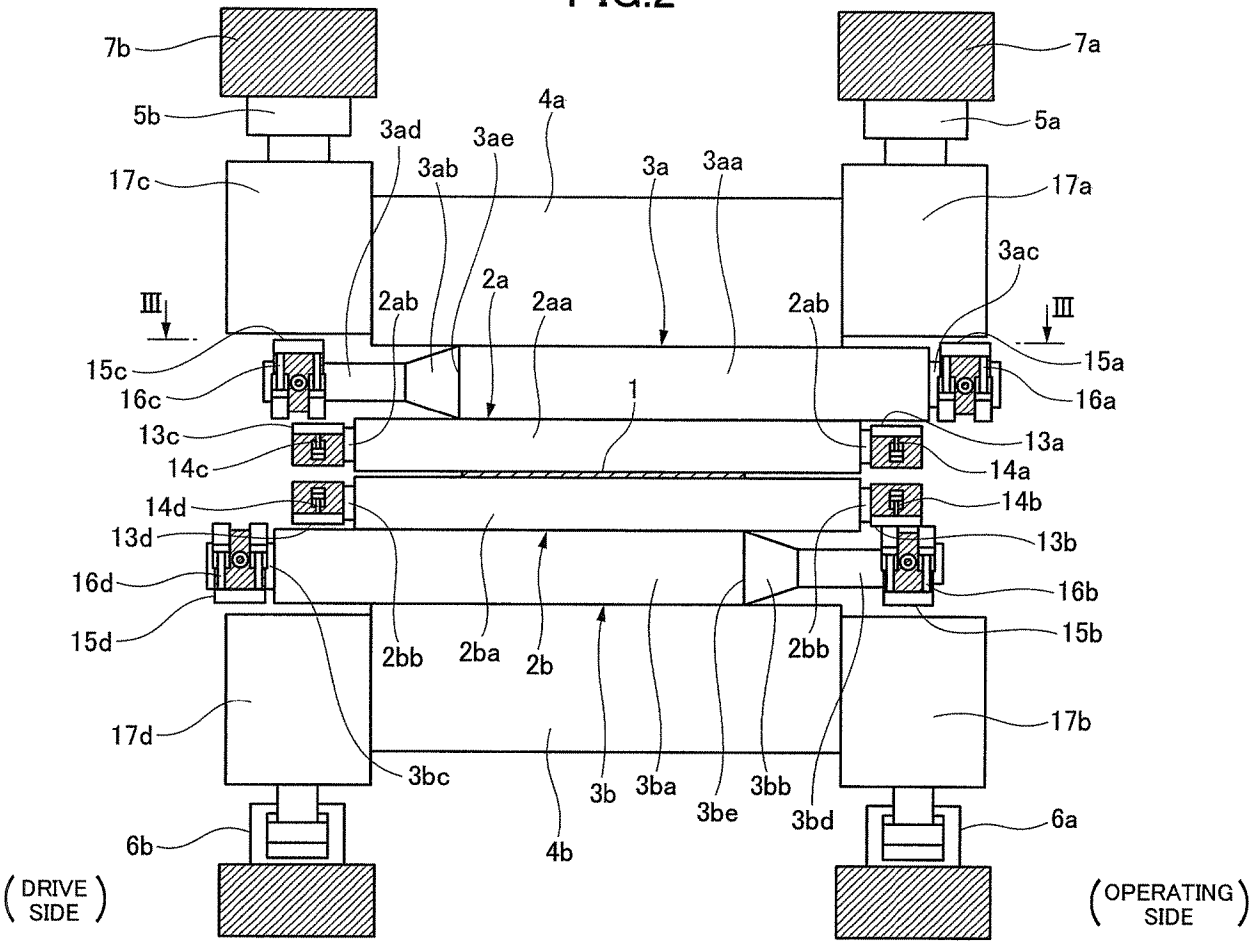
FIG. 2 is a cross-sectional view taken along line II-II in FIG. 1 and seen in the direction of arrows II in FIG. 1.

As shown in FIGS. 1 and 2, a six-high rolling mill according to the present embodiment includes left and right (drive side and operating side) housings 7*a*, 7*b* as a pair. Upper and lower work rolls 2*a*, 2*b* as a pair, upper and lower intermediate rolls 3*a*, 3*b* as a pair, and upper and lower back-up rolls 4*a*, 4*b* as a pair are rotatably supported inside the housings 7*a*, 7*b*. The work rolls 2*a*, 2*b* are in contact with and supported by the intermediate rolls 3*a*, 3*b*, respectively. The intermediate rolls 3*a*, 3*b* are in contact with and supported by the back-up rolls 4*a*, 4*b*, respectively. A rolling material 1 which is a hard material conveyed between the housings 7*a*, 7*b* are passed between the work rolls 2*a*, 2*b* and thereby rolled.

The upper back-up roll 4*a* is rotatably supported by bearings (not shown) and bearing chocks 17*a*, 17*c*. The bearing chocks 17*a*, 17*c* are supported by the housings 7*a*, 7*b* via pass line adjusting devices 5*a*, 5*b*. In other words, by driving the pass line adjusting devices 5*a*, 5*b*, the pass line for the rolling material 1 can be adjusted upward and downward.

Note that the pass line adjusting devices 5*a*, 5*b* include components such as worm jacks or taper wedges and stepped rocker plates, and load cells (not shown) may be incorporated inside these pass line adjusting devices 5*a*, 5*b* to measure rolling load.

On the other hand, the lower back-up roll 4*b* is rotatably supported by bearings (not shown) and bearing chocks 17*b*, 17*d*. The bearing chocks 17*b*, 17*d* are supported by the housings 7*a*, 7*b* via roll-gap controlling hydraulic cylinders 6*a*, 6*b*. Thus, by driving the roll-gap controlling hydraulic cylinders 6*a*, 6*b*, the resultant rolling force can be indirectly transmitted to the paired upper and lower work rolls 2*a*, 2*b* via the paired upper and lower back-up rolls 4*a*, 4*b* and the paired upper and lower intermediate rolls 3*a*, 3*b* and thereby roll the rolling material 1.

Here, as shown in. FIG. 2, the work rolls 2*a*, 2*b* include cylindrical roll body sections 2*aa*, 2*ba* for rolling the rolling material 1, and roll neck sections 2*ab*, 2*bb* formed on opposite end portions of the roll body sections 2*aa*, 2*ba*. The roll neck sections 2*ab* of the work roll 2*a* are rotatably supported by bearing chocks 13*a*, 13*c* via bearings (not shown). Similarly to the work roll 2*a*, the roll neck sections 2*bb* of the work roll 2*b* are rotatably supported by bearing chocks 13*b*, 13*d* via bearings (not shown).

Further, projection blocks 20*a*, 20*b* are disposed on opposite lateral sections of these bearing chocks 13*a*, 13*c* (the outlet side and the inlet side in the conveyance direction of the rolling material 1). Bending cylinders (roll bending devices) 14*a*, 14*c* are housed in these projection blocks 20*a*, 20*b*, respectively. The bending cylinders 14*a*, 14*c* can push the lower surfaces of the bearing chocks 13*a*, 13*c*. Also, similarly to the bearing chocks 13*a*, 13*c*, projection blocks 20*c*, 20*d* are disposed on opposite lateral sections of the bearing chocks 13*b*, 13*d* (the outlet side and the inlet side in the conveyance direction of the rolling material 1). Bending cylinders (roll bending devices) 14*b*, 14*d* are housed in these projection blocks 20*c*, 20*d*, respectively. The bending cylinders 14*b*, 14*d* can push the upper surfaces of the bearing chocks 13*b*, 13*d*. In this way, bending force is imparted to the work rolls 2*a*, 2*b*.

Here, the rolling force is imparted by the roll-gap controlling hydraulic cylinders 6*a*, 6*b*, as mentioned above. Rolling torque is directly transmitted to the paired upper and lower work rolls 2*a*, 2*b* by spindles not shown, or indirectly transmitted to the work rolls 2*a*, 2*b* by the spindles via the intermediate rolls 3*a*, 3*b*.

The paired upper and lower intermediate rolls 3*a*, 3*b* include cylindrical roll body sections 3*aa*, 3*ba* in contact with the roll body sections 2*aa*, 2*ba* of the work rolls 2*a*, 2*b*. Tapering sections 3*ab*, 3*bb* are formed at one ends of the roll body sections 3*aa*, 3*ba*. Roll neck sections 3*ac*, 3*bc* are formed at the other ends of the roll body sections 3*aa*, 3*ba*. Roll neck sections 3*ad*, 3*bd* are formed at the tips of the tapering sections 3*ab*, 3*bb*. The intermediate rolls 3*a*, 3*b* include roll shoulder portions 3*ae*, 3*be* from which the tapering sections 3*ab*, 3*bb* start (the positions where the surfaces start tapering). Specifically, the paired upper and lower intermediate rolls 3*a*, 3*b* respectively include the roll shoulder portions 3*ae*, 3*be* at end portions of the upper and lower roll body sections 3*aa*, 3*ba* that are point-symmetric about the center of the rolling material 1 in its strip width direction.

The roll neck sections 3*ac*, 3*ad* of the intermediate roll 3*a* are rotatably supported by bearing chocks 15*a*, 15*c* via bearings (not shown). Similarly to the intermediate roll 3*a*, the roll neck sections 3*bc*, 3*bd* of the intermediate roll 3*b* are rotatably supported by bearing chocks 15*b*, 15*d* via bearings (not shown).

Figure 3:
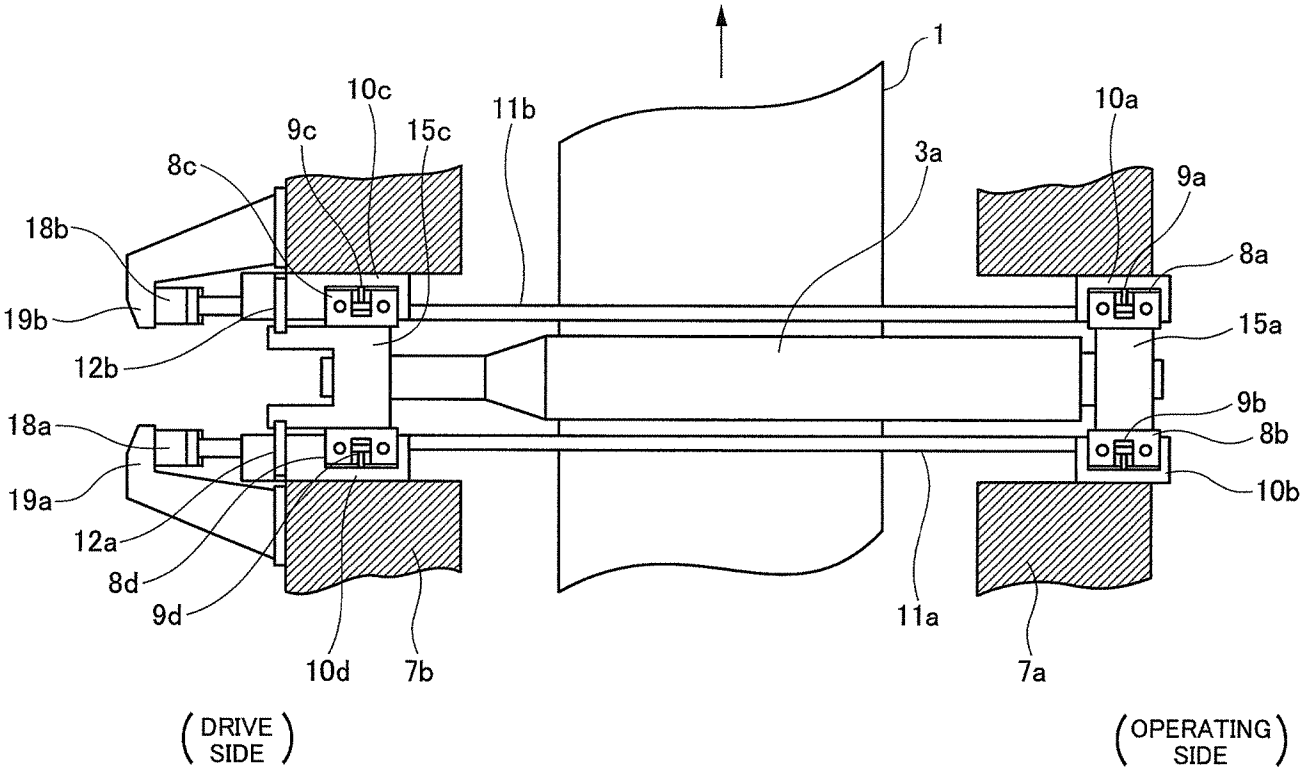
FIG. 3 is a cross-sectional view taken along line in FIG. 2 and seen in the direction of arrows III in FIG. 2.

As shown in FIG. 3, drive-side shift blocks 10*c*, 10*d* are detachably attached to the drive-side bearing chock 15*c* via attachment-detachment plates 12*a*, 12*b*. Moreover, shift cylinders 18*a*, 18*b* are interposed between the drive-side shift blocks 10*c*, 10*d* and shift frames 19*a*, 19*b* fixedly supported by the housing 7*b*.

Front and rear shift blocks 10*b*, 10*a* as a pair and the front and rear shift blocks 10*d*, 10*c* as a pair are provided on opposite lateral sections of the bearing chocks 15*a*, 15*c* (the inlet side and the outlet side in the conveyance direction of the rolling material 1). The paired shift blocks 10*b*, 10*a* and the paired shift blocks 10*d*, 10*c* facing each other are coupled by coupling bars 11*a*, 11*b* and supported slidably in the axial direction of the intermediate roll 3*a* between sidewalls of the housings 7*a*, 7*b*. Roll bender blocks 8*a*, 8*b*, 8*c*, 8*d* are disposed in the shift blocks 10*a*, 10*b*, 10*c*, 10*d*. Roll bending cylinders 16*a* are housed in the roll bender blocks 8*a*, 8*b*. Roll bending cylinders 16*c* are housed in the roll bender blocks 8*c*, 8*d*. These roll bending cylinders 16*a*, 16*c* can push the lower surfaces of the bearing chocks 15*a*, 15*c*. Thus, bending force can be imparted to the upper intermediate roll 3*a*.

Then, by driving the shift cylinders 18*a*, 18*b*, the intermediate roll 3*a* can be shifted in its axial direction. Moreover, with the shift of the bearing chocks 15*a*, 15*c*, the shift blocks 10*a* to 10*d* and the roll bender blocks 8*a* to 8*d* are shifted as well. In this way, bending force can be imparted by the bending cylinders 16*a*, 16*c*, and the strip shape of the rolling material 1 in the width direction can be controlled.

The intermediate roll 3*b* can also be shifted in its axial direction by members similar to those of the intermediate roll 3*a*.

Similarly to the bearing chocks 15*a*, 15*c*, paired front and rear shift blocks (not shown) are provided on opposite lateral sections of the bearing chocks 15*b*, 15*d* (the inlet side and the outlet side in the conveyance direction of the rolling material). Roll bender blocks (not shown) are disposed in the shift blocks. Roll bending cylinders 16*b* are housed in the operating-side roll bender blocks, and roll bending cylinders 16*d* are housed in the drive-side roll bender blocks. These roll bending cylinders 16*b*, 16*d* can push the upper surfaces of the bearing chocks 15*b*, 15*d*. Thus, bending force can be imparted to the lower intermediate roll 3*b*.

Then, by driving the shift cylinders, the intermediate roll 3*b* can be shifted in its axial direction. Moreover, with the shift of the bearing chocks 15*b*, 15*d*, the shift blocks and the roll bender blocks are shifted as well. In this way, bending force can be imparted by bending cylinders 16*b*, 16*d*, and the strip shape of the rolling material 1 in the width direction can be controlled.

Also, intermediate-roll-offset changing cylinders 9*a*, 9*b*, 9*c*, 9*d* are incorporated respectively in the roll bender blocks 8*a*, 8*b*, 8*c*, 8*d*, which are placed in the shift blocks 10*a*, 10*b*, 10*c*, 10*d* slidably in the pass direction. With these cylinders 9*a*, 9*b*, 9*c*, 9*d*, the upper intermediate roll 3*a* can be offset horizontally toward the inlet side or the outlet side via the bearing chocks 15*a*, 15*c*. Further, position sensors not shown are incorporated in the roll bender blocks 8*a*, 8*b*, 8*c*, 8*d*. Thus, the offset position of the intermediate roll can be detected.

Similarly to the roll bender blocks 8*a*, 8*b*, intermediate-roll-offset changing cylinders 9*e*, 9*f* are incorporated respectively in the operating-side roll bender blocks placed in the shift blocks for the lower intermediate roll 3*b* slidably in the pass direction. Similarly to the roll bender blocks 8*c*, 8*d*, intermediate-roll-offset changing cylinders 9*g*, 9*h* (see FIG. 4) are respectively incorporated in the drive-side roll bender blocks. With the operating-side and drive-side intermediate-roll-offset changing cylinders 9*e*, 9*f*, 9*g*, 9*h*, the lower intermediate roll 3*b* can be offset horizontally toward the inlet side or the outlet side via the bearing chocks 15*b*, 15*d*. Further, similarly to the roll bender blocks 8*a* to 8*d*, position sensors not shown are incorporated in the roll bender blocks for the lower intermediate roll 3*b*. Thus, the offset position of the intermediate roll can be detected.

Figure 4:
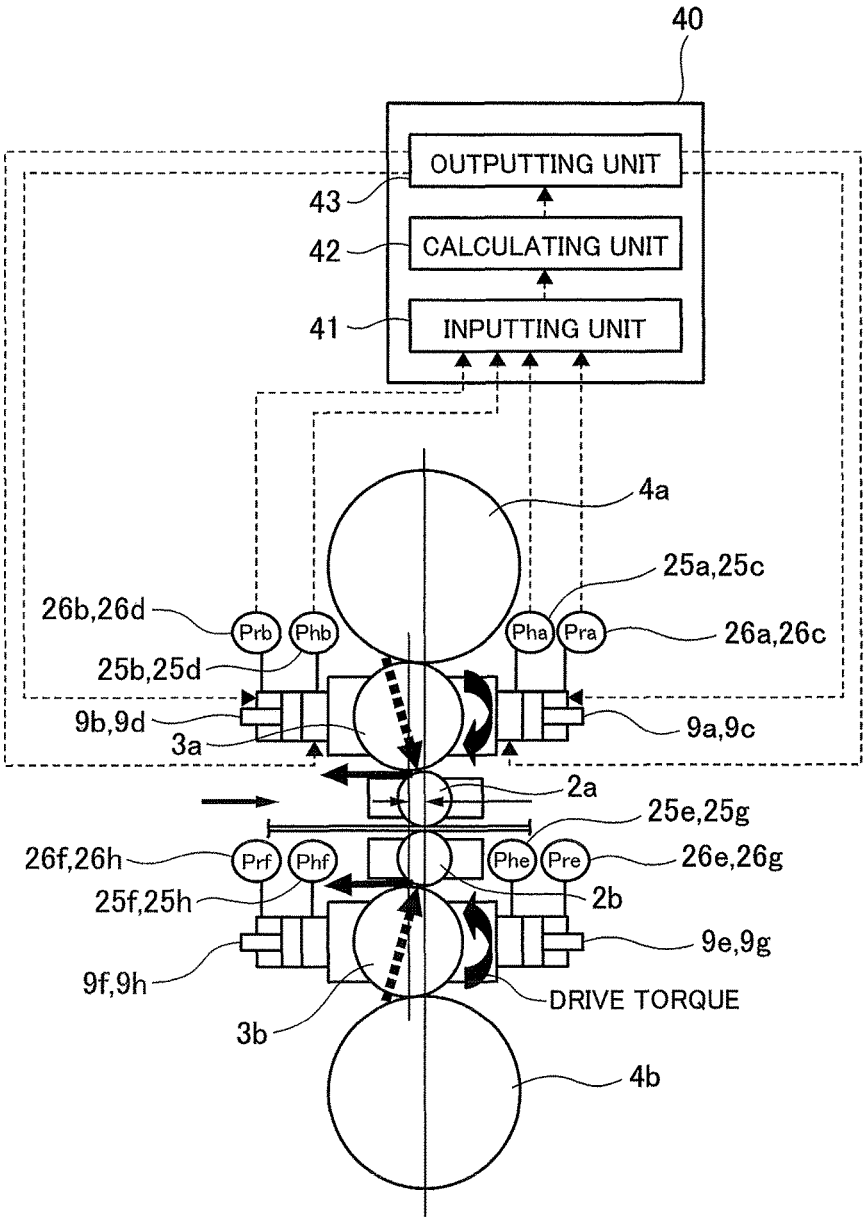
FIG. 4 is an explanatory view of the six-high rolling mill according to the first embodiment of the present invention.

Here, as shown in FIG. 4, pressure meters 25*a*, 25*b*, 25*c*, 25*d*, 25*e*, 25*f*, 25*g*, 25*h* are placed on the head sides of the intermediate-roll-offset changing cylinders 9*a*, 9*b*, 9*c*, 9*d*, 9*e*, 9*f*, 9*g*, 9*h*, and their head-side pressures can thus be detected. These head-side pressures will be denoted by Pha, Phb, Phc, Phd, Phe, Phf, Phg, Phh, respectively. Moreover, pressure meters 26*a*, 26*b*, 26*c*, 26*d*, 26*e*, 26*f*, 26*g*, 26*h* are placed on the rod sides of the intermediate-roll-offset changing cylinders 9*a*, 9*b*, 9*c*, 9*d*, 9*e*, 9*f*, 9*g*, 9*h*, and their rod-side pressures can thus be detected. These rod-side pressures will be denoted by Pra, Prb, Prc, Prd, Pre, Prf, Prg, Prh, respectively. These pressures are adjusted to control intermediate-roll offset positions β individually for the upper intermediate roll 3*a* and the lower intermediate roll 3*b*. The head-side area and the rod-side area of each of the intermediate-roll-offset changing cylinders 9*a*, 9*b*, 9*c*, 9*d*, 9*e*, 9*f*, 9*g*, 9*h* will be denoted by Ah, Ar, respectively. Meanwhile, of the intermediate-roll-offset changing cylinders 9*a*, 9*b*, 9*c*, 9*d*, 9*e*, 9*f*, 9*g*, 9*h*, those on any one of the inlet side and the outlet side may be subjected to positional control while the rest may be caused to push at constant pressure.

As described above, the cylinders 9*a* to 9*h* and the pressure meters 25*a* to 25*h*, 26*a* to 26*h* are placed at positions distant from the path of conveyance of the rolling material 1, such as the operating side and the drive side by the bearing chocks of the paired upper and lower intermediate rolls 3*a*, 3*b*. This arrangement eliminates the possibility of breakage due to strip breaking in the rolling material. The arrangement also prevents direct contact with spray of roll coolant and therefore eliminates the possibility of erroneous detection.

The six-high rolling mill further includes a controlling device 40 configured to control the instruments mentioned above and other relevant elements by using meters such as the pressure meters 25*a* to 25*h*, 26*a* to 26*h*. The controlling device 40 includes an inputting unit 41, a calculating unit 42, and an outputting unit 43. The inputting unit 41 of the controlling device 40 is connected to the output sides of the meters such as the pressure meters 25*a* to 25*h*, 26*a* to 26*h* by signal lines. The calculating unit 42 is connected to the inputting unit 41, and is configured to receive the above data inputted via the inputting unit 41. The calculating unit 42 is connected to the outputting unit 43, and is capable of outputting the results of calculations by the calculating unit 42, which will be described later in detail, to corresponding instruments.

Now, a method of setting the offset position of each intermediate roll will be described.

Figure 5:
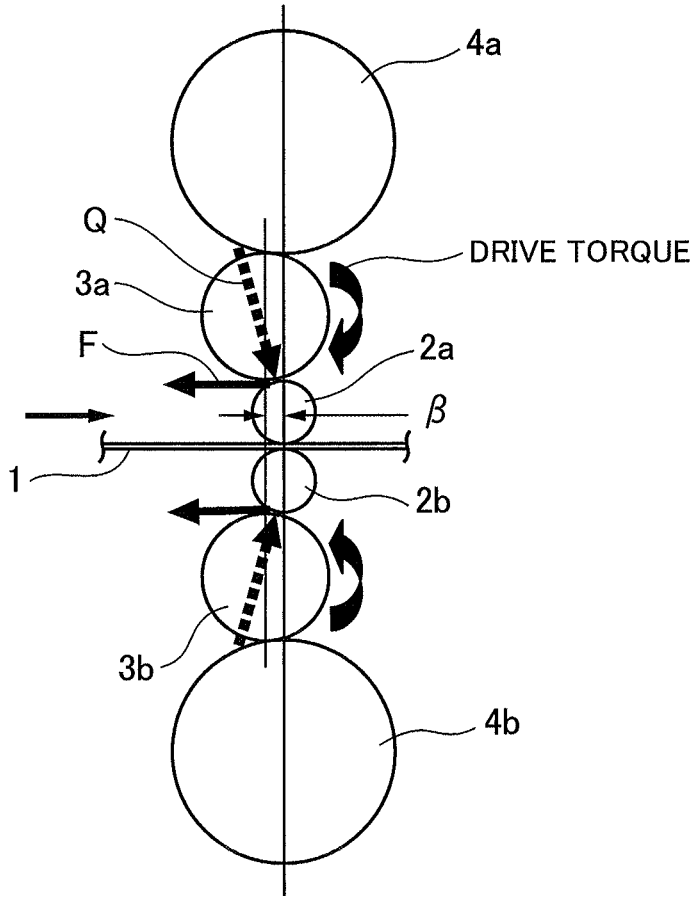
FIG. 5 is an explanatory view of offset of intermediate rolls in a case of driving the intermediate rolls in the six-high rolling mill.
Figure 6A:
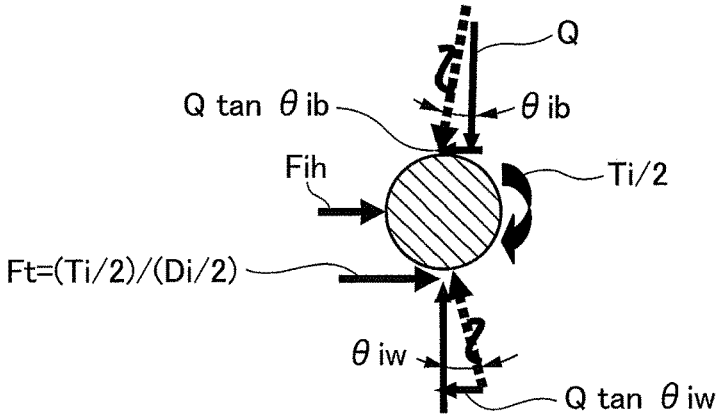
FIG. 6A is an explanatory view of loads applied to each intermediate roll included in the six-high rolling mill.
Figure 6B:
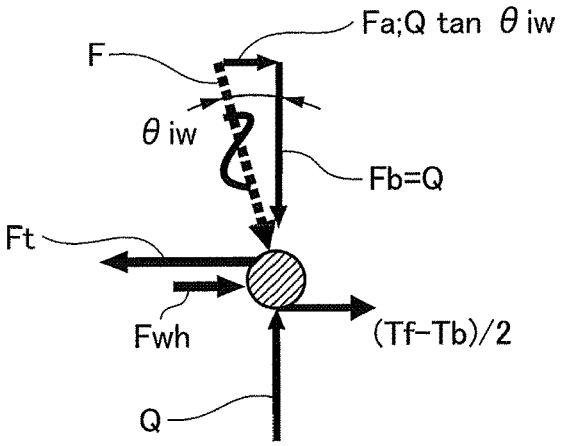
FIG. 6B is an explanatory view of loads applied to each work roll included in the six-high rolling mill.

1) First, in a case of driving the paired upper and lower intermediate rolls 3*a*, 3*b*, forces as shown FIGS. 5, 6A, 6B are exerted on the paired upper and lower work rolls 2*a*, 2*b* and the intermediate rolls.

a) A horizontal force Fih on each intermediate roll 3*a*, 3*b*, which is applied to its intermediate-roll chocks (the bearing chocks for the intermediate roll), is expressed by formula (1) below.

$$Fih=-Ft+Q(\tan\theta ib+\tan\theta iw) \quad (1)$$

where Ft represents a drive tangential force, and Q represents a rolling load.

Note that, as the rolling load, it is possible to use, for example, a value measured by each load cell mentioned above, a calculated value calculated from the pressure in each roll-gap controlling hydraulic cylinder 6*a*, 6*b*.

Moreover, with β being the offset amount of the intermediate roll 3*a*, 3*b*, θib, θiw are expressed by formulas (2), (3) below.

$$\sin\theta ib=\beta/((Db+Di)/2)) \quad (2)$$

$$\sin\theta iw=\beta/((Di+Dw)/2)) \quad (3)$$

where Dw represents the diameter of the work rolls 2*a*, 2*b*, Di represents the diameter of the intermediate rolls 3*a*, 3*b*, and Db represents the diameter of the back-up rolls 4*a*, 4*b*.

b) Next, a horizontal force Fwh on each work roll 2*a*, 2*b*, which is applied to its work-roll chocks (the bearing chocks for the work roll), is expressed by formula (4) below.

$$Fwh=Ft-Q\cdot\tan\theta iw-(Tf-Tb)/2 \quad (4)$$

where Ft represents the drive tangential force, Q represents the rolling load, Tf represents a tension on the outlet side in the conveyance direction of the rolling material 1 relative to the work rolls 2*a*, 2*b* (outlet-side tension), and Tb represents a tension on the inlet side in the conveyance direction of the rolling material 1 relative to the work rolls 2*a*, 2*b* (inlet-side tension). Note that values measured by tension meters or the like not shown, for example, can be used as the outlet-side tension and the inlet-side tension.

Moreover, the drive tangential force Ft is expressed by formula (5) below.

$$Ft=(Ti/2)/(Di/2) \quad (5)$$

where Ti represents the total value of the upper and lower drive torques of the intermediate rolls 3*a*, 3*b*, and Di represents the diameter of the intermediate rolls 3*a*, 3*b*.

With the outputs of the intermediate-roll-offset changing cylinders 9*a*, 9*b*, 9*c*, 9*d* taken into account, the horizontal force Fih on the upper intermediate roll 3*a*, which is applied to the upper intermediate roll chocks, is expressed by formula (6) below.

$$Fih=(Ah\cdot Pha-Ar\cdot Pra)+(Ah\cdot Phc-Ar\cdot Prc)-(Ah\cdot Phb-Ar\cdot Prb)-(Ah\cdot Phd-Ar\cdot Prd) \quad (6)$$

Here, if formula (1) above is converted into an equality with FT, then formula (1a) below is obtained.

$$Ft=-Fih+Q(\tan\theta ib+\tan\theta iw) \quad (1a)$$

If formula (6) above is substituted into formula (1a) above, then formula (1b) below is obtained.

$$Ft=-(Ah\cdot Pha-Ar\cdot Pra)-(Ah\cdot Phc-Ar\cdot Prc)+(Ah\cdot Phb-Ar\cdot Prb)+(Ah\cdot Phd-Ar\cdot Prd)+Q(\tan\theta ib+\tan\theta iw) \quad (1b)$$

If formula (1a) above is substituted into formula (4) above, then formula (4a) below is obtained.

$$Fwh=-Fih+Q(\tan\theta ib+\tan\theta iw)-Q\cdot\tan\theta iw-(Tf-Tb)/2=-Fih+Q\cdot\tan\theta ib-(Tf-Tb)/2 \quad (4a)$$

Here, if formula (2) above is converted into an equality with θib, then, formula (2a) below is obtained.

$$\theta ib=\sin^{-1}\{\beta/((Db+Di)/2)\} \quad (2a)$$

If formula (2a) above is substituted into formula (4a) above, then, formula (4b) below is obtained.

$$Fwh=-Fih+Q\cdot\tan[\sin^{-1}\{\beta/((Db+Di)/2)\}]-(Tf-Tb)/2 \quad (4b)$$

Here, θib is sufficiently small such that a relation sinθib≅tanθib holds in formula (4b) above. Hence, formula (4b) above is formula (4c) below.

$$Fwh=-Fih+2Q\cdot\beta/((Db+Di)-(Tf-Tb)/2 \quad (4c)$$

Then, in formula (4c) above, the offset amount β of each of the upper and lower intermediate rolls 3*a*, 3*b* is calculated as such a value that Fwh can be equal to 0 or near 0 (less than or equal to a predetermined value), and the offset position of each of the upper and lower intermediate rolls 3*a*, 3*b* is controlled such that the intermediate roll 3*a*, 3*b* is offset by this value. In this way, a good strip shape can be obtained although the diameter of the work rolls 2*a*, 2*b* is reduced for the purpose of reducing the rolling load.

Meanwhile, for the lower work roll 2*b*, Fih above is expressed by formula (7) below.

$$Fih=(Ah\cdot Phe-Ar\cdot Pre)+(Ah\cdot Phg-Ar\cdot Prg)-(Ah\cdot Phf-Ar\cdot Prf)-(Ah\cdot Phh-Ar\cdot Prh) \quad (7)$$

Similarly, a correct drive tangential force Ft is calculated from formulas (7), (1) above, and this value of Ft is substituted into formula (4) to calculate Fwh on the lower work roll 2*b*. Further, the offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value. In this way, a good strip shape can be obtained although the diameter of the work rolls 2*a*, 2*b* is reduced for the purpose of reducing the rolling load.

Figure 7:
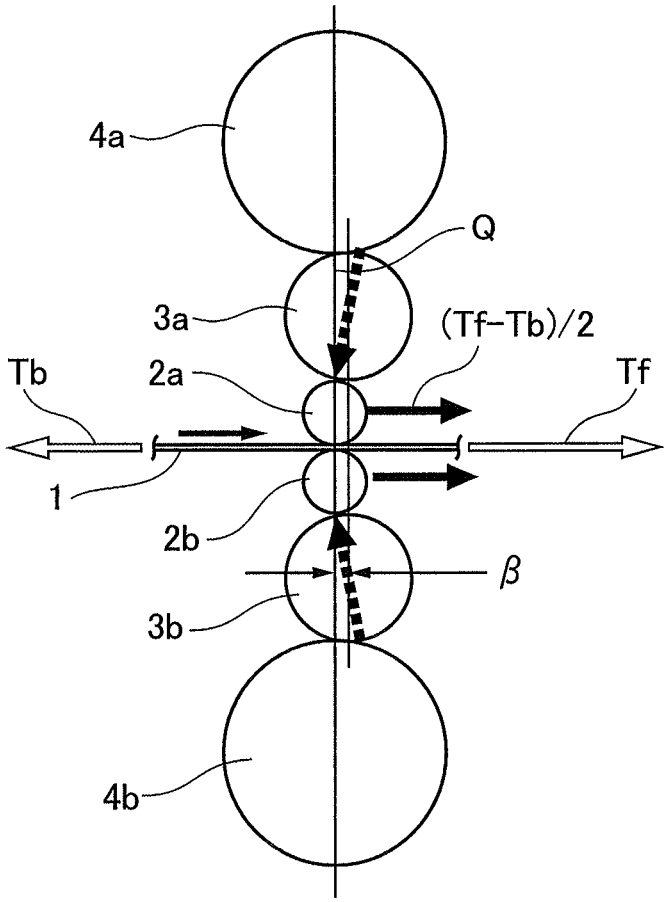
FIG. 7 is an explanatory view of offset of the intermediate rolls in a case of driving the work rolls in the six-high rolling mill.
Figure 8A:
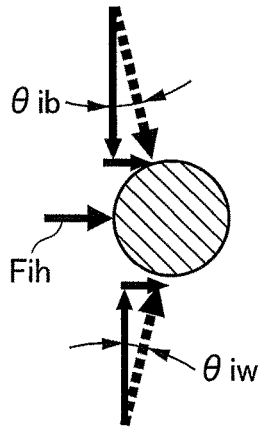
FIG. 8A is an explanatory view of loads applied to the intermediate rolls included in the six-high rolling mill.
Figure 8B:
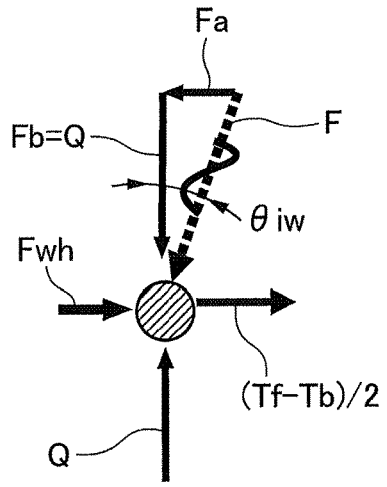
FIG. 8B is an explanatory view of loads applied to the work rolls included in the six-high rolling mill.

2) Next, in a case of driving the work rolls 2*a*, 2*b*, forces as shown in FIGS. 7, 8A, 8B are exerted on the paired upper and lower work rolls 2*a*, 2*b* and the paired upper and lower intermediate rolls 3*a*, 3*b*.

a) An intermediate-roll horizontal force Fih, which is applied to the intermediate roll chocks (the bearing chocks for the intermediate roll), is expressed by formula (8) below.

$$Fih=-Q(\tan\theta ib+\tan\theta iw) \quad (8)$$

where Q represents a rolling load.

b) A work-roll horizontal force Fwh, which is applied to the work-roll chocks (the bearing chocks for the work roll), is expressed by formula (9) below.

$$Fwh=Q\cdot\tan\theta iw-(Tf-Tb)/2 \quad (9)$$

The rolling load Q is calculated from formulas (6), (8) above, and this value of Q is substituted into formula (9) to calculate Fwh on the upper work roll 2*a*. Further, the offset amount β of the upper intermediate roll 3*a* is calculated as such a value that this Fwh can be equal to 0 or near 0 (less than or equal to a predetermined value), and the offset position of the upper intermediate roll 3*a* is controlled such that the upper intermediate roll 3*a* is offset by that value.

Similarly, the rolling load Q is calculated from formulas (7), (8) above and this value of Q is substituted into formula (9) to calculate Fwh on the lower work roll 2*b*. Further, the offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value. In this way, a good strip shape can be obtained although the diameter of the work rolls 2*a*, 2*b* is reduced for the purpose of reducing the rolling load.

Figure 9:
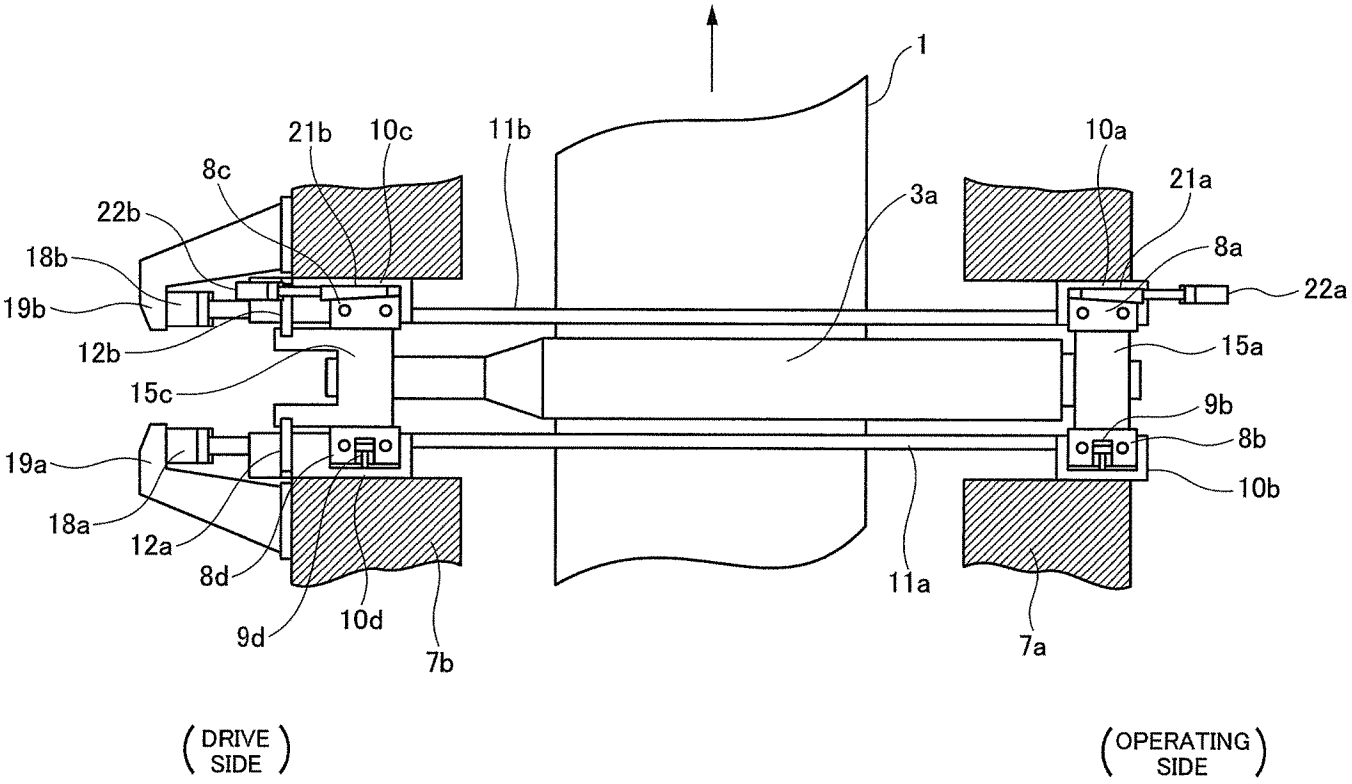
FIG. 9 is an explanatory view showing another example of position adjusting devices for the intermediate rolls included in the six-high rolling mill.

Here, as shown in FIG. 9, wedge liners 21*a*, 21*b* and axially-operating cylinders 22*a*, 22*b* can be placed only on the outlet side in the conveyance direction of the rolling material 1 relative to the intermediate roll 3*a* instead of the intermediate-roll-offset changing cylinders 9*a*, 9*c*, and the rest can be kept as intermediate-roll-offset changing cylinders. Alternatively, wedge liners and axially-operating cylinders can be placed instead of only those among the intermediate-roll-offset changing cylinders 9*a* to 9*h* that are placed on one of the inlet side and the outlet side in the conveyance direction of the rolling material 1 relative to the intermediate rolls 3*a*, 3*b*, and the rest can be kept as intermediate-roll-offset changing cylinders.

Figure 10:
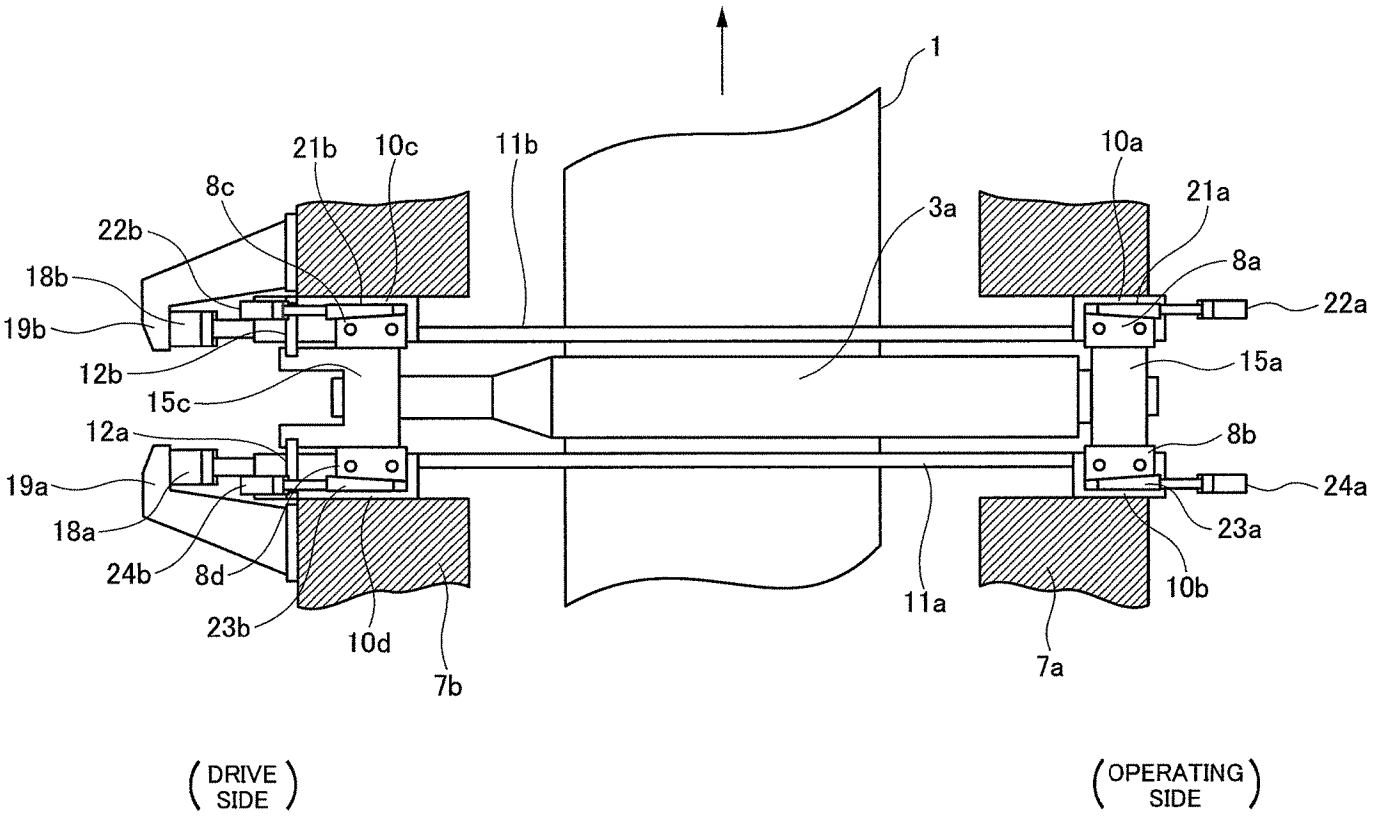
FIG. 10 is an explanatory view showing still another example of the position adjusting devices for the intermediate rolls included in the six-high rolling mill.

Further, as shown in FIG. 10, the wedge liners 21*a*, 21*b* and the axially-operating cylinders 22*a*, 22*b* can be placed on the outlet side in the conveyance direction of the rolling material 1 relative to the intermediate roll 3*a* instead of the intermediate-roll-offset changing cylinders 9*a*, 9*c*, and wedge liners 23*c*, 23*d* and axially-operating cylinders 22*c*, 22*d* can be placed on the inlet side in the conveyance direction of the rolling material 1 relative to the intermediate roll 3*a* instead of the intermediate-roll-offset changing cylinders 9*b*, 9*d*. Alternatively, wedge liners and axially-operating cylinders can be placed on the inlet side and the outlet side in the conveyance direction of the rolling material 1 relative to the intermediate roll 3*a* instead of the intermediate-roll-offset changing cylinders 9*a* to 9*h*, respectively.

Thus, in the present embodiment, the horizontal forces on the paired upper and lower work rolls 2*a*, 2*b* are detected with detectors and, based on these detection values, the offset amounts β of the upper and lower intermediate rolls 3*a*, 3*b* are controlled as such values that the horizontal forces on the paired upper and lower work rolls 2*a*, 2*b* can be equal to 0 or near 0 (less than or equal to the predetermined value). This makes the upper and lower work rolls 2*a*, 2*b* more resistant to horizontally deflection. Hence, a rolling material 1 with a good strip shape can be obtained.

Note that the paired upper and lower work rolls included in the six-high rolling mill are preferably such that D/B being the ratio of a diameter D of the work rolls 2*a*, 2*b* to a strip width B of the rolling material 1 satisfies inequality (10) below.

$$0.08\leq D/B\leq 0.23 \quad (10)$$

This is because the work rolls 2*a*, 2*b* are more likely to have deflection that makes it difficult to obtain the desired strip shape if D/B above is less than 0.08, and because sufficient rolling load is obtained even without offset if D/B above is greater than 0.23.

Figure 11:
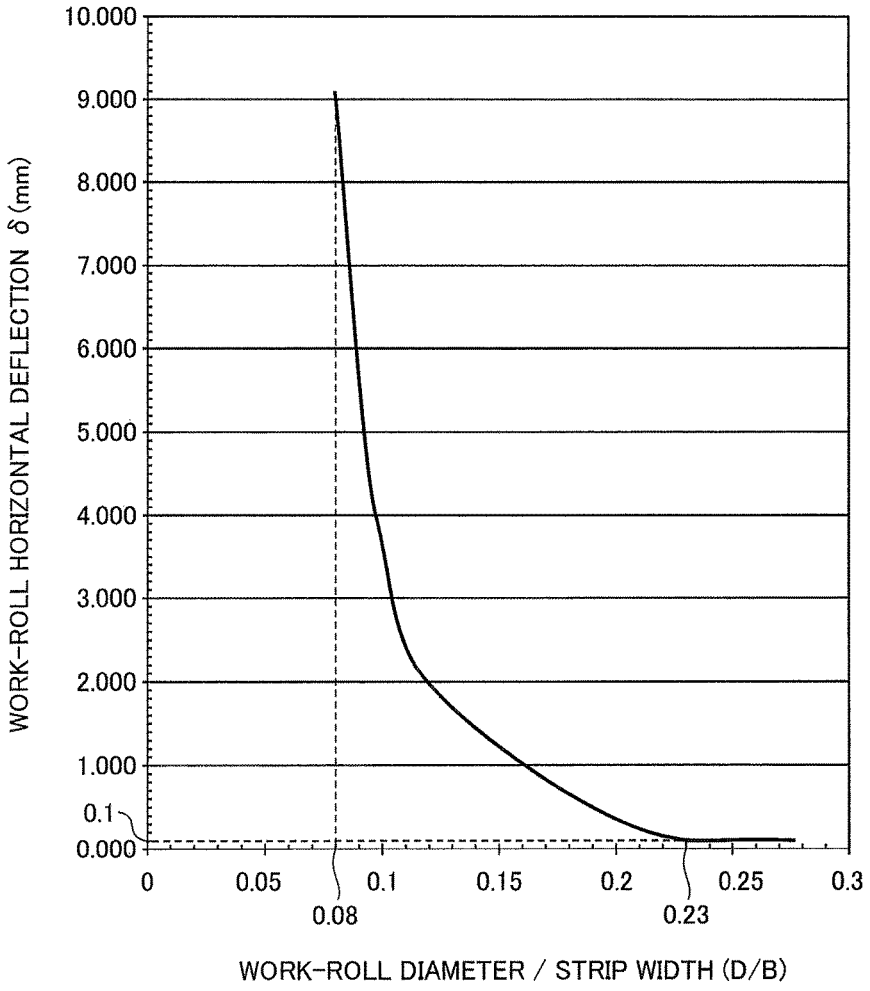
FIG. 11 is a graph showing the relation between the ratio of a work-roll diameter D to a strip width B and work-roll horizontal deflection δ.
Figure 12:
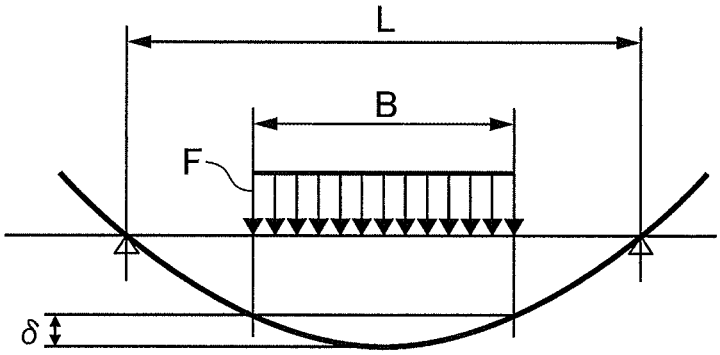
FIG. 12 is an explanatory view of the work-roll deflection.

Now, the range of D/B above will be described using FIGS. 11 and 12 showing the relation between D/B and the work-roll horizontal deflection. Note that FIG. 11 shows an instance where the process-target rolling material is 120-*k* high tensile strength steel, the strip width of the rolling material is 1650 mm, the inlet-side strip thickness of the rolling material is 2.34 mm, and the outlet-side strip thickness of the rolling material is 1.99 mm. In FIG. 12, reference sign B represents the strip width of the rolling material, reference sign L represents the distance between the bearings of each work roll, reference sign F represents horizontal components of force from the work roll, and reference sign δ represents the horizontal deflection of the work roll.

As is obvious from the graph mentioned above, it is found that setting D/B greater than or equal to 0.08 but less than or equal to 0.23 can suppress the horizontal deflection of the work roll and suppress unevenness in the strip shape of the rolling material due to the horizontal deflection of the work roll.

{Embodiment 2}

A rolling mill and a rolling method according to a second embodiment of the present invention will be described with reference to FIG. 13.

The present embodiment has a configuration obtained by adding load cells to the first embodiment, which is shown in FIGS. 1 to 4 and described above. The other features of the configuration are mostly similar to the rolling mill shown in FIGS. 1 to 4 and described above. The same instruments will be denoted by the same reference signs, and redundant description thereof will be omitted as appropriate.

Figure 13:
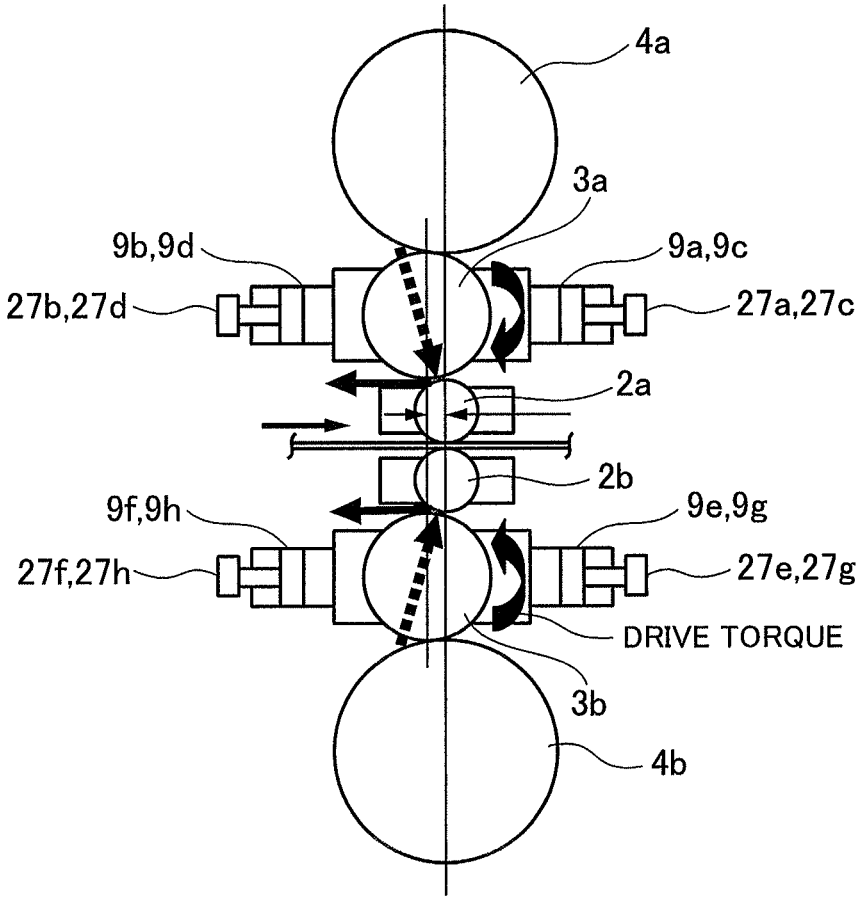
FIG. 13 is an explanatory view of a six-high rolling mill according to a second embodiment of the present invention.

As shown in FIG. 13, the rolling mill according the present embodiment includes load cells 27*a*, 27*b*, 27*c*, 27*d*, 27*e*, 27*f*, 27*g*, 27*h* disposed between the above-mentioned shift blocks and intermediate-roll-offset changing cylinders 9*a*, 9*b*, 9*c*, 9*d*, 9*e*, 9*f*, 9*g*, 9*h*.

Note that the load cells 27*b*, 27*d* are disposed on the inlet side in the conveyance direction of a rolling material 1 relative to an upper intermediate roll 3*a*. The load cells 27*a*, 27*c* are disposed on the outlet side in the conveyance direction of the rolling material 1 relative to the upper intermediate roll 3*a*. The load cells 27*f*, 27*h* are disposed on the inlet side in the conveyance direction of the rolling material 1 relative to a lower intermediate roll 3*b*. The load cells 27*e*, 27*g* are disposed on the outlet side in the conveyance direction of the rolling material 1 relative to the lower intermediate roll 3*b*.

Here, the outputs of the load cells 27*a*, 27*b*, 27*c*, 27*d*, 27*e*, 27*f*, 27*g*, 27*h* are denoted by Ria, Rib, Ric, Rid, Rie, Rif, Rig, Rih, respectively. Then, a horizontal force Fih on each intermediate roll 3*a*, 3*b*, which is applied to its intermediate-roll chocks (bearing chocks for the intermediate roll), is expressed by formula (11) below for an upper work roll 2*a*.

$$Fih=(Ria+Ric)-(Rib+Rid) \quad (11)$$

1) First, in a case of driving the intermediate rolls 3*a*, 3*b*, a correct drive tangential force Ft is calculated from formulas (11), (1) above, and this value of Ft is substituted into formula (4) to calculate Fwh on the upper work roll 2*a*. Further, an offset amount β of the upper intermediate roll 3*a* is calculated as such a value that this Fwh can be equal to 0 or near 0 (less than or equal to a predetermined value), and the offset position of the upper intermediate roll 3*a* is controlled such that the upper intermediate roll 3*a* is offset by that value.

Also, the following describes the case of a lower work roll. Fih is expressed by formula (12).

$$Fih=(Rie+Rig)-(Rif+Rih) \quad (12)$$

Similarly, a correct drive tangential force Ft is calculated from formulas (12), (1) above, and this value of Ft is substituted into formula (4) to calculate Fwh on the lower work roll. Further, an offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value.

2) Next, in a case of driving the work rolls 2*a*, 2*b*, a rolling load Q is calculated from formulas (11), (8) above, and this value of Q is substituted into formula (9) to calculate Fwh. Further, the offset amount β of the upper intermediate roll 3*a* is calculated as such a value that this Fwh can be equal to 0 or near 0 (less than or equal to the predetermined value), and the offset position of the upper intermediate roll 3*a* is controlled such that the upper intermediate roll 3*a* is offset by that value.

Similarly, a rolling load Q is calculated from formulas (12), (8) above, and this value of Q is substituted into formula (9) to calculate Fwh. Further, the offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value.

Here, if those among the intermediate-roll-offset changing cylinders 9*a* to 9*h* on any one of the inlet side and the outlet side in the conveyance direction of the rolling material 1 are subjected to positional control and those on the other side are caused to push at constant pressure, the above load cells may be placed only on the one of the inlet side and the outlet side in the conveyance direction of the rolling material 1 where the intermediate-roll-offset changing cylinders are subjected to positional control. For example, assume that the outlet-side intermediate-roll-offset changing cylinders 9*a*, 9*c*, 9*e*, 9*g* are subjected to positional control while the opposite, inlet-side intermediate-roll-offset changing cylinders 9*b*, 9*d*, 9*f*, 9*h* are caused to push at constant pressure, and only the load cells 27*a*, 27*c*, 27*e*, 27*g* on the outlet side in the conveyance direction of the rolling material 1 are placed. In this case, push forces calculated from the values of the pushing by the inlet-side intermediate-roll-offset changing cylinders 9*b*, 9*d*, 9*f*, 9*h* at constant pressure are used as the values of Rib, Rid, Rif, Rih in Formulas (11), (12).

1) First, in the case of driving the intermediate rolls 3*a*, 3*b*, the correct drive tangential force Ft is calculated from formulas (11), (1) above, and this value of Ft is substituted into formula (4) to calculate Fwh on the upper work roll 2*a*. Further, the offset amount β of the upper intermediate roll 3*a* is calculated as such a value that this Fwh can be equal to 0 or near 0 (less than or equal to the predetermined value), and the offset position of the upper intermediate roll 3*a* is controlled such that the upper intermediate roll 3*a* is offset by that value. Also, similarly, for the lower work roll 2*b*, the correct drive tangential force Ft is calculated from formulas (12), (1), and this value of Ft is substituted into formula (4) to calculate Fwh on the lower work roll 2*b*. Further, the offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value.

2) Next, in the case of driving the work rolls 2*a*, 2*b*, the rolling load Q is calculated from formulas (11), (8) above, and this value of Q is substituted into formula (9) to calculate Fwh on the upper work roll 2*a*. Further, the offset amount β of the upper intermediate roll 3*a* is calculated as such a value that this Fwh can be equal to 0 or near 0 (less than or equal to the predetermined value), and the offset position of the upper intermediate roll 3*a* is controlled such that the upper intermediate roll 3*a* is offset by that value.

Similarly, the rolling load Q is calculated from formulas (12), (8) above, and this value of Q is substituted into formula (9) to calculate Fwh on the lower work roll 2*b*. Further, the offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value.

Thus, in the present embodiment, similarly to the above first embodiment, the cylinders 9*a* to 9*h* and the load cells 27*a* to 27*h* are placed at positions distant from the path of conveyance of the rolling material 1, such as the operating side and the drive side by the bearing chocks of the paired upper and lower intermediate rolls 3*a*, 3*b*, as described above. This arrangement eliminates the possibility of breakage due to strip breaking in the rolling material. The arrangement also prevents direct contact with spray of roll coolant and therefore eliminates the possibility of erroneous detection.

{Embodiment 3}

A rolling mill and a rolling method according to a third embodiment of the present invention will be described with reference to FIG. 14.

The present embodiment has a configuration obtained by adding load cells to the first embodiment, which is shown in FIGS. 1 to 4 and described above. The other features of the configuration are mostly similar to the rolling mill shown in FIGS. 1 to 4 and described above. The same instruments will be denoted by the same reference signs, and redundant description thereof will be omitted as appropriate.

Figure 14:
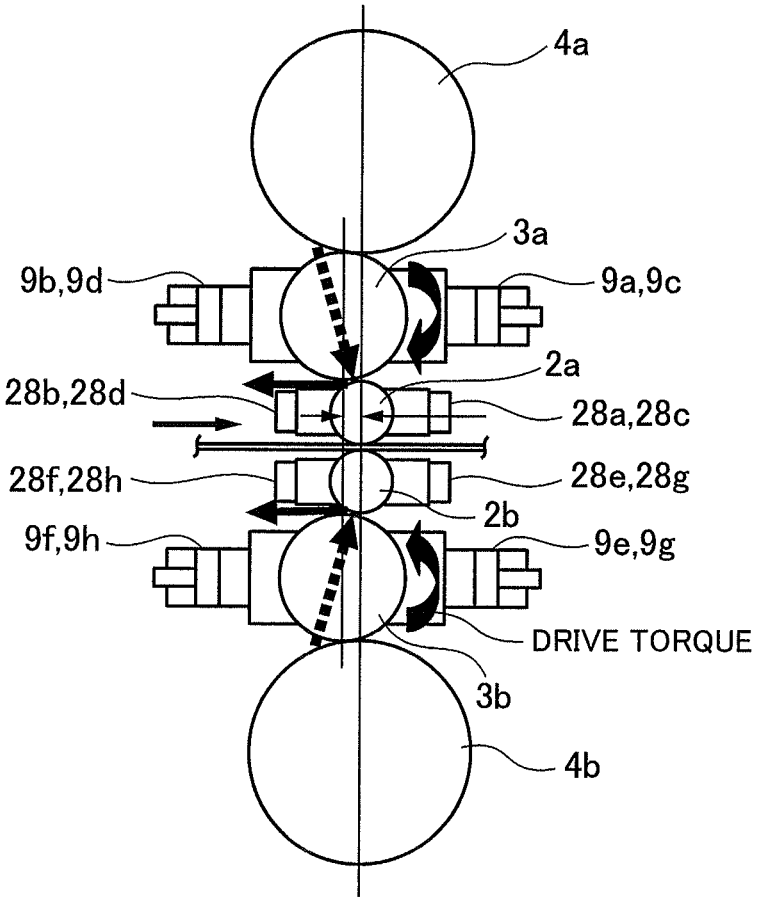
FIG. 14 is an explanatory view of a six-high rolling mill according to a third embodiment of the present invention.

As shown in FIG. 14, the rolling mill according to the present embodiment includes load cells 28*a*, 28*b*, 28*c*, 28*d*, 28*e*, 28*f*, 28*g*, 28*h* disposed between bearing chocks for work rolls 2*a*, 2*b* and the projection blocks mentioned above.

Note that the load cells 28*b*, 28*d* are disposed on the inlet side in the conveyance direction of a rolling material 1 relative to the upper work roll 2*a*. The load cells 28*a*, 28*c* are disposed on the outlet side in the conveyance direction of the rolling material 1 relative to the upper work roll 2*a*. The load cells 28*f*, 28*h* are disposed on the inlet side in the conveyance direction of the rolling material 1 relative to the lower work roll 2*b*. The load cells 28*e*, 28*g* are disposed on the outlet side in the conveyance direction of the rolling material 1 relative to the lower work roll 2*b*.

Here, the outputs of the load cells 28*a*, 28*b*, 28*c*, 28*d*, 28*e*, 28*f*, 28*g*, 28*h* will be denoted by Rwa, Rwb, Rwc, Rwd, Rwe, Rwf, Rwg, Rwh, respectively.

1) In a case of driving intermediate rolls or the work rolls, a horizontal force Fhw on each work roll 2*a*, 2*b*, which is applied to its work roll chocks (the bearing chocks for the work roll), namely the horizontal force Fhw on the upper work roll 2*a* is expressed by formula (13) below.

$$Fwh=(Rwa+Rwc)-(Rwb+Rwd) \quad (13)$$

An offset amount β of the upper intermediate roll 3*a* is calculated as such a value that Fwh on the upper work roll 2*a*, which is calculated from formula (13) above, can be equal to 0 or near 0 (less than or equal to a predetermined value), and the offset position of the upper intermediate roll 3*a* is controlled such that the upper intermediate roll 3*a* is offset by that value.

Also, Fwh on the lower work roll 2*b* is expressed by formula (14) below.

$$Fwh=(Rwe+Rwg)-(Rwf+Rwh) \quad (14)$$

Similarly, an offset amount β of the lower intermediate roll 3*b* is calculated as such a value that Fwh on the lower work roll 2*b*, which is calculated from formula (14) above, can be equal to 0 or near 0 (less than or equal to the predetermined value), and the offset position of the lower intermediate roll 3*b* is controlled such that the lower intermediate roll 3*b* is offset by that value.

Here, of the load cells mentioned above, only those on any one of the inlet side and the outlet side in the conveyance direction of the rolling material 1 relative to the work rolls 2*a*, 2*b* may be placed. For example, only the load cells 28*a*, 28*c*, 28*e*, 28*g* on the outlet side in the conveyance direction of the rolling material 1 relative to the work rolls 2*a*, 2*b* may be placed. In this case, the values of Rwb, Rwd, Rwf, Rwh are set to 0 in formulas (13), (14) above.

In this condition, the offset amount β of the upper intermediate roll 3*a* is calculated as such a value that Fwh on the upper work roll 2*a*, which is calculated from formula (13), can be a positive value near 0, and the offset position of the upper intermediate roll 3*a* is controlled such that the upper intermediate roll 3*a* is offset by that value.

Similarly, the offset amount β of the lower intermediate roll 3*b* is calculated as such a value that Fwh on the lower work roll 2*b*, which is calculated from formula (14), can be a positive value near 0, and the offset position of the lower intermediate roll 3*b* is controlled such that the lower intermediate roll 3*b* is offset by that value.

Thus, in the present embodiment, similarly to the above first embodiment, the above-mentioned cylinders 9*a* to 9*h* and the load cells 28*a* to 28*h* are placed at positions distant from the path of conveyance of the rolling material 1, such as the operating side and the drive side by the bearing chocks of the paired upper and lower work rolls 2*a*, 2*b* and intermediate rolls 3*a*, 3*b*, as described above. This arrangement eliminates the possibility of breakage due to strip breaking in the rolling material. The arrangement also prevents direct contact with spray of roll coolant and therefore eliminates the possibility of erroneous detection.

{Embodiment 4}

A rolling mill and a rolling method according to a fourth embodiment of the present invention will be described with reference to FIG. 15.

Figure 15:
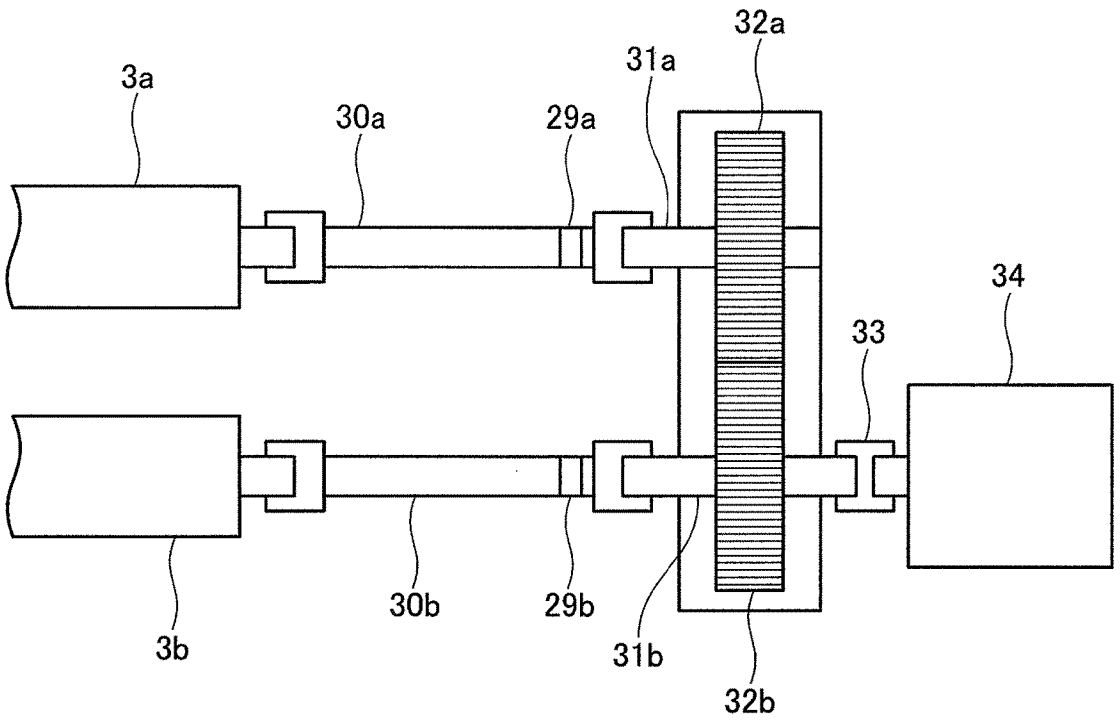
FIG. 15 is an explanatory view of a drive system for intermediate rolls included in a six-high rolling mill according to a fourth embodiment of the present invention.

As shown in FIG. 15, in the rolling mill according to the present embodiment, an upper intermediate roll 3*a* is rotatably coupled to a pinion shaft 31*a* via a spindle 30*a*. A pinion 32*a* provided on the pinion shaft 31*a* is in mesh with a pinion 32*b*. On the other hand, a lower intermediate roll 3*b* is rotatably coupled to a pinion shaft 31*b* via a spindle 30*b*. The pinion 32*b*, which is provided on the pinion shaft 31*b*, is rotatably coupled to an electric motor 34 via a coupling 33. The electric motor 34 is configured to generate drive torque. Here, the spindles 30*a*, 30*b* are provided respectively with torque meters 29*a*, 29*b* capable of measuring the drive torque.

The torques measured by the torque meters 29*a*, 29*b* are denoted by Tia, Tib, respectively. Then, for the upper intermediate roll 3*a*, formula (5) is expressed as formula (15) below.

$$Ft=(Tia/2)/(Di/2) \quad (15)$$

A correct drive tangential force Ft is calculated from formula (15) above, and this value of Ft is substituted into formula (4) to calculate Fwh on an upper work roll 2*a*. Further, an offset amount β of the upper intermediate roll 3*a* is calculated as such a value that this Fwh can be equal to 0 or near 0 (less than or equal to a predetermined value), and the offset position of the upper intermediate roll 3*a* is controlled such that the upper intermediate roll 3*a* is offset by that value.

Also, for the lower intermediate roll 3*b*, formula (5) is expressed as formula (16) below.

$$Ft=(Tib/2)/(Di/2) \quad (16)$$

Similarly, a correct drive tangential force Ft is calculated from formula (16) above, and this value of Ft is substituted into formula (4) to calculate Fwh on a lower work roll 2*b*. Further, an offset amount β of the lower intermediate roll 3*b* is calculated as such a value that this Fwh can be equal 0 or near 0 (less than or equal to the predetermined value), and the offset position of the lower intermediate roll 3*b* is controlled such that the lower intermediate roll 3*b* is offset by that value.

Thus, in the present embodiment, similarly to the above first embodiment, the torque meters 29*a*, 29*b* are placed at positions distant from the path of conveyance of a rolling material 1. This arrangement eliminates the possibility of breakage due to strip breaking in the rolling material. The arrangement also prevents direct contact with spray of roll coolant and therefore eliminates the possibility of erroneous detection.

{Embodiment 5}

A rolling mill and a rolling method according to a fifth embodiment of the present invention will be described with reference to FIG. 16.

Figure 16:
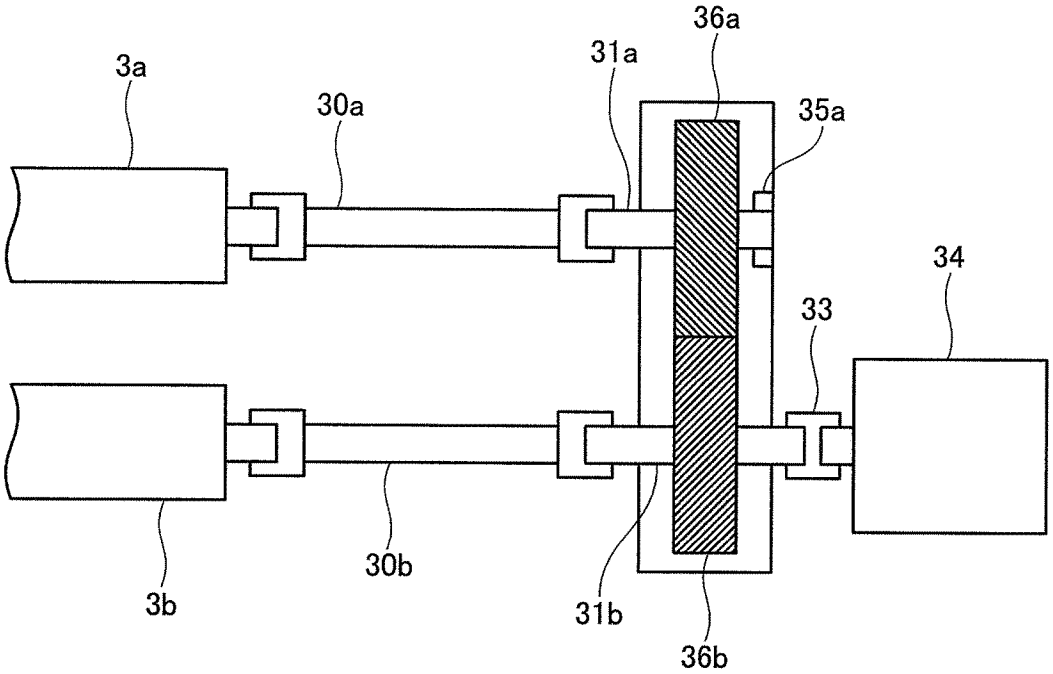
FIG. 16 is an explanatory view of a drive system for intermediate rolls included in a six-high rolling mill according to a fifth embodiment of the present invention.

As shown in FIG. 16, in the rolling mill according to the present embodiment, an upper intermediate roll 3*a* is rotatably coupled to a pinion shaft 31*a* via a spindle 30*a*. A pinion 36*a* provided on the pinion shaft 31*a* is in mesh with a pinion 36*b*. On the other hand, a lower intermediate roll 3*b* is rotatably coupled to a pinion shaft 31*b* via a spindle 30*b*. The pinion 36*b*, which is provided on the pinion shaft 31*b*, is rotatably coupled to an electric motor 34 via a coupling 33. The electric motor 34 is configured to generate drive torque. Here, the pinions 36*a*, 36*b* are helical gears and axially generates a thrust force equivalent to the angle at which teeth of the helical gears obliquely mesh with each other. A load cell 35*a* capable of measuring this thrust force is provided on an end portion of the pinion shaft 31*a*. This thrust force is proportional to the torque. Then, by measuring the thrust force with the load cell 35*a*, the torque of the upper intermediate roll 3*a* is calculated. This torque will be denoted by Tia. Also, an electric motor torque that can be calculated from the value of the current at the electric motor 34 is denoted by Tm. Then, the torque of the lower intermediate roll 3*b* is expressed by formula (17) below.

$$Tib=Tm-Tia \quad (17)$$

For an upper work roll 2*a*, Tia above is used to calculate a correct drive tangential force Ft from formula (15) above, and this value of Ft is substituted into formula (4) to calculate Fwh on the upper work roll 2*a*. Further, an offset amount β of the upper intermediate roll 3*a* is calculated as such a value that this Fwh can be equal to 0 or near 0 (less than or equal to a predetermined value), and the offset position of the upper intermediate roll 3*a* is controlled such that the upper intermediate roll 3*a* is offset by that value.

Similarly, for a lower work roll 2*b*, Tib above is used to calculate a correct drive tangential force Ft from formula (16) above, and this value of Ft is substituted into formula (4) to calculate Fwh on the lower work roll 2*b*. Further, an offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value.

Thus, in the present embodiment, similarly to the above first embodiment, the load cell 35*a* and the electric motor 34 are placed at positions distant from the path of conveyance of a rolling material 1. This arrangement eliminates the possibility of breakage due to strip breaking in the rolling material. The arrangement also prevents direct contact with spray of roll coolant and therefore eliminates the possibility of erroneous detection.

{Embodiment 6}

Figure 17:
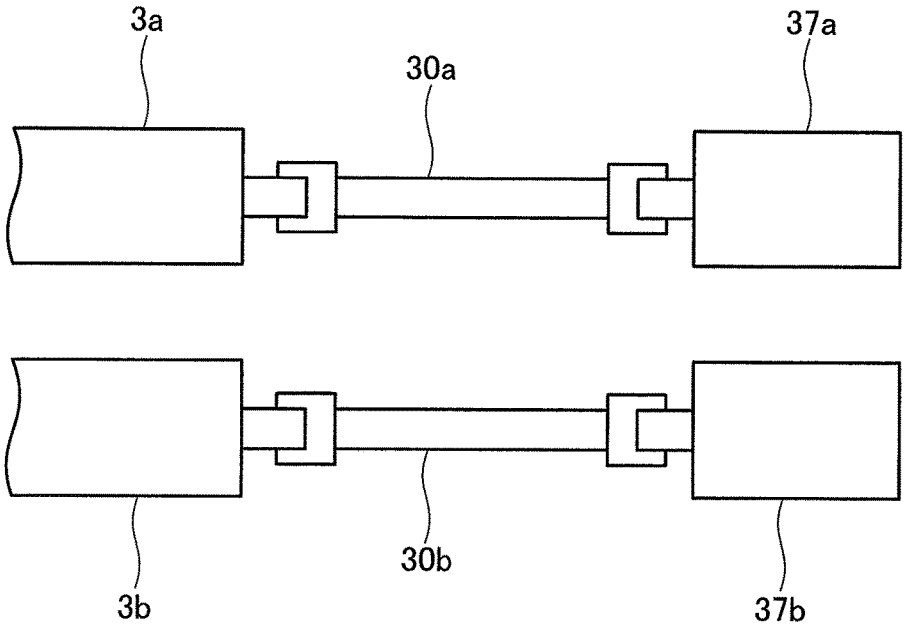
FIG. 17 is an explanatory view of a drive system for intermediate rolls included in a six-high rolling mill according to a sixth embodiment of the present invention.

A rolling mill and a rolling method according to a sixth embodiment of the present invention will be described with reference to. FIG. 17.

As shown in FIG. 17, in the rolling mill according to the present embodiment, an upper intermediate roll 3*a* is rotatably coupled to a motor 37*a* via a spindle 30*a*. The motor 37*a* is configured to generate drive torque. On the other hand, a lower intermediate roll 3*b* is rotatably coupled to a motor 37*b* via a spindle 30*b*. The motor 37*b* is configured to generate drive torque. Motor torques that can be calculated from the values of the currents at the motors 37*a*, 37*b* will be denoted by Tia, Tib, respectively.

For an upper work roll 2*a*, Tia above is used to calculate a correct drive tangential force Ft from formula (15) above, and this value of Ft is substituted into formula (4) to calculate Fwh on the upper work roll 2*a*. Further, an offset amount β of the upper intermediate roll 3*a* is calculated as such a value that this Fwh can be equal to 0 or near 0 (less than or equal to a predetermined value), and the offset position of the upper intermediate roll 3*a* is controlled such that the upper intermediate roll 3*a* is offset by that value.

Similarly, for a lower work roll 2*b*, Tib above is used to calculate a correct drive tangential force Ft from formula (16) above, and this value of Ft is substituted into formula (4) to calculate Fwh on the lower work roll 2*b*. Further, an offset amount β of the lower intermediate roll 3*b* is calculated as such a value that this Fwh can be equal to 0 or near 0 (less than or equal to the predetermined value), and the offset position of the lower intermediate roll 3*b* is controlled such that the lower intermediate roll 3*b* is offset by that value.

Thus, in the present embodiment, similarly to the above first embodiment, the electric motors 37*a*, 37*b* are placed at positions distant from the path of conveyance of a rolling material 1. This arrangement eliminates the possibility of breakage due to strip breaking in the rolling material. The arrangement also prevents direct contact with spray of roll coolant and therefore eliminates the possibility of erroneous detection.

Figure 18:
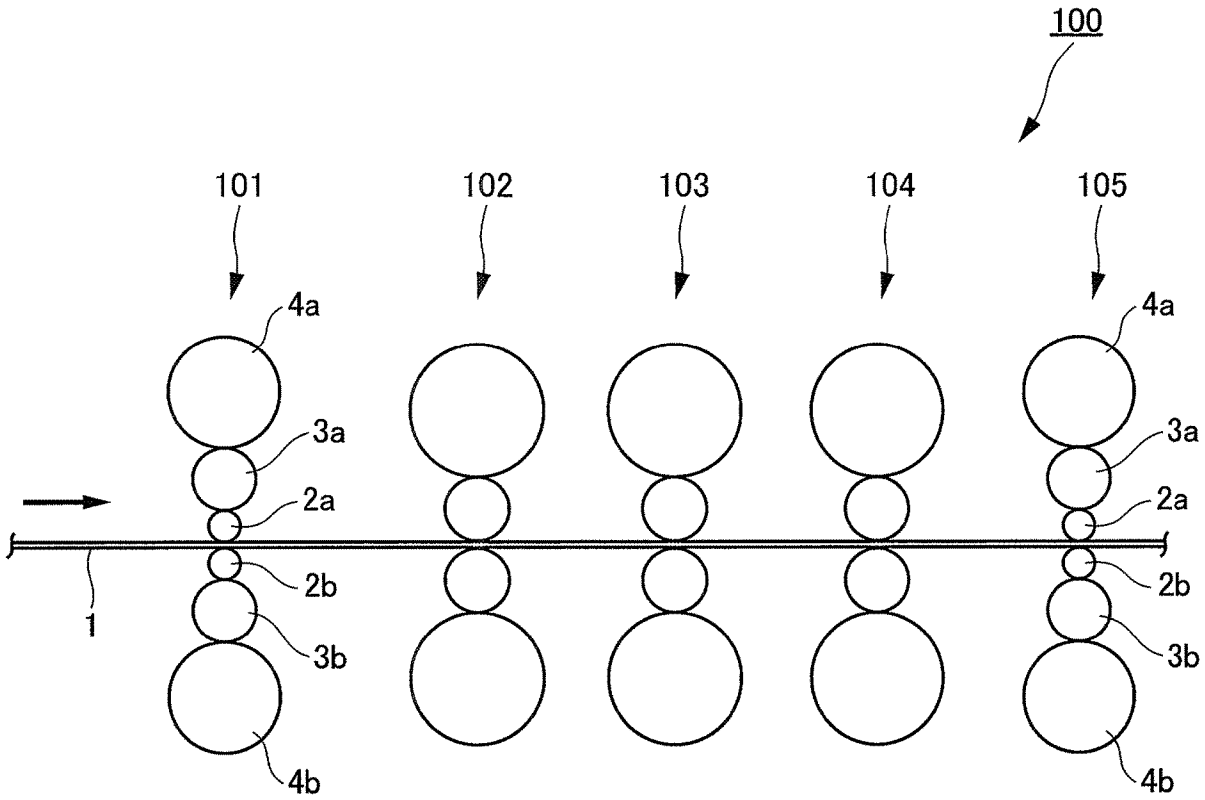
FIG. 18 is an explanatory view showing an example of application to a tandem rolling line.

Here, each of the six-high rolling mills according to the above first to sixth embodiments can be employed as each single rolling mill stand of a tandem rolling line including first to fifth rolling mill stands. In this case, a hard rolling material 1 can be rolled more efficiently. Alternatively, as shown in FIG. 18, each of the above six-high rolling mills can be employed in a tandem rolling line 100 including first to fifth rolling mill stands 101 to 105 as only the first rolling mill stand 101 and the fifth (last) rolling mill stand 105. In this case, at the first rolling mill stand 101, even if the strip thickness of the rolling material 1 is large, the small-diameter work rolls 2*a*, 2*b* can accordingly increase the reduction in strip thickness. On the other hand, at the fifth (last) rolling mill stand 105, even if the strip thickness of the rolling material 1 is small, the intermediate rolls 3*a*, 3*b* can be operated to be offset accordingly, and the shape of the rolling material 1 in strip thickness can therefore be accurately controlled. Thus, the return on investment is large. Still alternatively, each of the above six-high rolling mills can be employed in a tandem rolling line including first to fifth rolling mill stands as only the first or fifth (last) rolling mill stand.

REFERENCE SIGNS LIST

1 STRIP (ROLLING MATERIAL)
2*a*, 2*b* WORK ROLL
3*a*, 3*b* INTERMEDIATE ROLL
4*a*, 4*b* BACK-UP ROLL
5*a*, 5*b* PASS LINE ADJUSTING DEVICE
6*a*, 6*b* HYDRAULIC CYLINDER
7*a*, 7*b* HOUSING
8*a* TO 8*d* ROLL BENDER BLOCK
9*a* TO 9*h* INTERMEDIATE-ROLL-OFFSET CHANGING CYLINDERS (OFFSET CYLINDER, POSITION ADJUSTING MEANS)
10*a* TO 10*d* SHIFT BLOCK
13*a* TO 13*d* BEARING CHOCK (BEARING) FOR WORK ROLL
15*a* TO 15*d* BEARING CHOCK (BEARING) FOR INTERMEDIATE ROLL
25*a* TO 25*h* PRESSURE METER (PRESSURE MEASURING MEANS)
26*a* TO 26*h* PRESSURE METER (PRESSURE MEASURING MEANS)
27*a* TO 27*h* LOAD CELL (INTERMEDIATE-ROLL LOAD MEASURING MEANS)
28*a* TO 28*h* LOAD CELL (WORK-ROLL LOAD MEASURING MEANS)
29*a*, 29*b* TORQUE METER (DRIVE-TORQUE MEASURING MEANS)
35*a* LOAD CELL (THRUST-FORCE MEASURING MEANS)
40 CONTROLLING DEVICE
42 CALCULATING UNIT (OFFSET-AMOUNT CALCULATING MEANS)
43 OUTPUTTING UNIT (CONTROLLING MEANS)
100 TANDEM ROLLING LINE

The invention claimed is:

1. A rolling mill comprising:

upper and lower work rolls as a pair configured to roll a rolling material;

upper and lower intermediate rolls as a pair supporting the paired upper and lower work rolls from above and below, respectively, and being supported movably in a roll axial direction, the paired upper and lower intermediate rolls including tapering sections at end portions of the paired upper and lower intermediate rolls that are point-symmetric about a center of the rolling material in a strip width direction thereof;

upper and lower back-up rolls as a pair supporting the paired upper and lower intermediate rolls from above and below, respectively;

position adjusting means for adjusting positions of the paired upper and lower intermediate rolls relative to the paired upper and lower work rolls and the paired upper and lower back-up rolls in a direction of conveyance of the rolling material;

detecting means for detecting horizontal forces on the work rolls;

offset-amount calculating means for calculating offset amounts of the intermediate rolls based on the horizontal forces on the work rolls detected by the detecting means; and controlling means for controlling the position adjusting means such that the positions of the intermediate rolls are offset by the offset amounts calculated by the offset-amount calculating means, wherein the position adjusting means is offset cylinders provided to bearing chocks of the intermediate rolls, the detecting means includes pressure measuring means provided to the offset cylinders for measuring pressures in the offset cylinders, and the offset-amount calculating means calculates the horizontal forces on the work rolls based on measured pressure values obtained by the pressure measuring means.

2. The rolling mill according to claim 1, wherein the offset-amount calculating means calculates the offset amounts of the intermediate rolls such that the horizontal forces on the work rolls are each less than or equal to a predetermined value.

3. A tandem rolling line comprising a plurality of rolling mills arranged in tandem, wherein the tandem rolling line comprises the rolling mill according to claim 1 as at least one of the plurality of rolling mills.

4. A rolling mill comprising:

upper and lower work rolls as a pair configured to roll a rolling material;

upper and lower intermediate rolls as a pair supporting the paired upper and lower work rolls from above and below, respectively, and being supported movably in a roll axial direction, the paired upper and lower intermediate rolls including tapering sections at end portions of the paired upper and lower intermediate rolls that are point-symmetric about a center of the rolling material in a strip width direction thereof;

upper and lower back-up rolls as a pair supporting the paired upper and lower intermediate rolls from above and below, respectively;

position adjusting means for adjusting positions of the paired upper and lower intermediate rolls relative to the paired upper and lower work rolls and the paired upper and lower back-up rolls in a direction of conveyance of the rolling material;

detecting means for detecting horizontal forces on the work rolls;

offset-amount calculating means for calculating offset amounts of the intermediate rolls based on the horizontal forces on the work rolls detected by the detecting means; and controlling means for controlling the position adjusting means such that the positions of the intermediate rolls are offset by the offset amounts calculated by the offset-amount calculating means, wherein the detecting means includes load measuring means provided to bearing chocks of the intermediate rolls for measuring horizontal loads on the intermediate rolls, and the offset-amount calculating means calculates the horizontal forces on the work rolls based on the horizontal loads on the intermediate rolls measured by the load measuring means.

5. A rolling method using a rolling mill including upper and lower work rolls as a pair configured to roll a rolling material, upper and lower intermediate rolls as a pair supporting the paired upper and lower work rolls from above and below, respectively, and being supported movably in a roll axial direction, the paired upper and lower intermediate rolls including tapering sections at end portions of the paired upper and lower intermediate rolls that are point-symmetric about a center of the rolling material in a strip width direction thereof, upper and lower back-up rolls as a pair supporting the paired upper and lower intermediate rolls from above and below, respectively, and position adjusting means for adjusting positions of the paired upper and lower intermediate rolls relative to the paired upper and lower work rolls and the paired upper and lower back-up rolls in a direction of conveyance of the rolling material, the position adjusting means including offset cylinders provided to bearing chocks of the intermediate rolls, the rolling method comprising:

measuring pressures in the offset cylinders, calculating horizontal forces on the paired upper and lower work rolls based on the measured pressures obtained in the measuring step;

calculating offset amounts of the intermediate rolls based on the calculated horizontal forces on the work rolls; and controlling the position adjusting means such that the positions of the intermediate rolls are offset by the calculated offset amounts.

* * * * *